US005169479A

United States Patent [19]

Hoddinott et al.

[11] Patent Number: 5,169,479

[45] Date of Patent: Dec. 8, 1992

[54] WIRE TAKE-UP APPARATUS WITH TAPE APPLICATOR FOR APPLYING TAPE TO TERMINAL END PORTION OF WIRE

[75] Inventors: David C. Hoddinott, Preston; James P. Kudelchuk, Voluntown, both of Conn.

[73] Assignee: Crompton & Knowles Corporation, Stamford, Conn.

[21] Appl. No.: 687,017

[22] Filed: Apr. 18, 1991

[51] Int. Cl.[5] ..... B32B 31/18

[52] U.S. Cl. ..... 156/355; 156/353; 156/428; 156/511; 156/517; 156/522; 242/7.08; 242/164

[58] Field of Search ..... 156/169, 166, 187, 191, 156/184, 517, 353, 355, 433, 429, 428, 522, 475, 443, 566, 425, 511; 242/56 R, 56.6, 164, 7.08

[56] References Cited

U.S. PATENT DOCUMENTS

| | | | |
|---|---|---|---|
| 2,585,227 | 2/1952 | Christman | 242/56.6 |
| 3,253,794 | 5/1966 | Twigg | 242/56 R |
| 3,970,259 | 7/1976 | Schmid | 242/56 R |
| 4,111,737 | 9/1978 | Wesky | 156/187 X |
| 4,351,687 | 9/1982 | Lesage | 242/56 R |
| 4,456,190 | 6/1984 | Karttunen et al. | 242/56 R |
| 4,518,083 | 4/1986 | Schulz et al. | 156/191 X |
| 4,878,628 | 11/1989 | Takeda et al. | 242/56 R |
| 5,030,311 | 7/1991 | Michal et al. | 156/517 X |

*Primary Examiner*—Jeff H. Aftergut

*Attorney, Agent, or Firm*—Salter, Michaelson & Benson

[57] ABSTRACT

A wire take-up apparatus for applying wire to a wire spool includes a tape applicator assembly for automatically applying a length of adhesive tape to the outer terminal end portion of the wire applied to a spool in order to prevent the wire from unraveling from the spool. The tape applicator assembly includes a vacuum roller assembly including a vacuum roller element which is operative for releasably retaining a portion of a length of tape on the outer surface thereof so that the adhesive surface of the tape faces outwardly. The vacuum roller assembly is movable to a position wherein the tape on the vacuum roller element thereof contacts the wire on a wire spool to apply the tape to the wire.

20 Claims, 4 Drawing Sheets

10
12
14
14a
16
18
18a
19
19a
20
22
24
26
28
28a
30
31
32
34
35
36
38
42
44
46
48
49
50
51
52
54
56
57
58
59
60
61
62
64
66
68
70
100
110
120
144
146
150
154
156

WIRE TAKE-UP APPARATUS WITH TAPE APPLICATOR FOR APPLYING TAPE TO TERMINAL END PORTION OF WIRE

BACKGROUND AND SUMMARY OF THE INVENTION

The instant invention relates to apparatus for applying wire to spools and more particularly to a wire take-up apparatus which includes a tape applicator mechanism for applying a length of adhesive tape to the exposed free terminal end portion of the wire applied to a spool in order to prevent unraveling thereof.

Wire take-up apparatus have been successfully utilized for applying wire to spools for many years. One of the most common and effective types of wire take-up apparatus comprises dual take-up reels which are alternatively operative for receiving wire from a continuous wire production facility, such as a cable extrusion line. An apparatus of this type generally comprises cross-over means for cutting the wire after a predetermined amount thereof has been applied to a first spool, and for then feeding the wire onto a second spool without interrupting the flow of wire. The heretofore available dual reel take-up apparatus have generally been constructed as either coaxial dual reel apparatus, or parallel axis dual reel apparatus. In either case, they have been found to be effective for taking up wire at relatively high speeds, such as speeds in excess of 2000 feet per minute. Wire take-up apparatus of these types are illustrated in a 1984 article from *Wire Journal International* entitled "The Economic Impact of Dual Reel Take-Up Performance" by Stuart Walton and David Hoddinott, one of the co-inventors of the subject invention.

One of the main difficulties with the heretofore available wire take-up apparatus is that once a predetermined length of wire has been wound onto a spool and the wire has been cut so that the spool can be removed from the apparatus, the free end portion of the wire on the full spool is loose and free to unravel therefrom. As a result, heretofore it has generally been necessary to manually remove a full wire spool from a wire take-up apparatus, to manually rewind the free terminal end portion of the wire thereon, and to then manually apply retaining means, such as a length of adhesive tape to the free terminal end portion of the wire.

The instant invention represents a significant advancement in the art relating to wire take-up apparatus by providing means for automatically applying a length of adhesive tape to the terminal end portion of the wire on a spool as the wire is cut after a predetermined length thereof has been applied to the spool. More specifically, the wire take-up apparatus of the instant invention includes a vacuum roller having a resiliently cushioned outer surface, means for applying a vacuum to the outer surface of the vacuum roller, and means for supplying a length of adhesive tape to the vacuum roller so that the adhesive surface of the tape faces outwardly and so that the tape is retained on the vacuum roller by the vacuum means. The means for supplying a length of adhesive tape preferably includes a tape supply roll, and a tape accumulator between the tape supply roll and the vacuum roller for releasably accumulating a length of tape between the tape supply roll and the vacuum roller so that the tape in the accumulator can be rapidly dispensed to the vacuum roller from the accumulator. The apparatus further includes means for moving the vacuum roller with the tape thereon into engagement with the wire on the outer circumferential surface of a rotating spool of wire so that the tape is adhered to the wire and drawn from the vacuum roller and the accumulator as the wire spool is rotated. The apparatus further includes a tape knife assembly for cutting the tape after a length thereof has been applied to the wire on a wire spool. The means for moving the vacuum roller is preferably operative for moving the vacuum roller toward a spool of wire until the adhesive surface of the tape contacts the wire on the spool and for then immediately retracting the vacuum roller to a position of spaced disengagement from the spool. The tape knife assembly preferably includes a pivot arm having a free terminal end, a pivot head which is pivotally mounted on the pivot arm adjacent the free terminal end thereof, and a knife blade on the pivot head. The tape knife assembly preferably further includes means for pivoting the pivot arm to a position wherein the pivot head engages the adhesive surface of the tape between the vacuum roller and the adjacent spool of wire after a length of tape has been applied to the wire so that the tape causes the pivot head to be pivoted to a position wherein the knife blade contacts the tape to cut the latter. The apparatus preferably further includes a brake mechanism for braking the rotation of the vacuum roller immediately upon cutting the tape, and an air jet for urging the portion of the tape remaining after a cutting operation toward the vacuum roller so that the free end portion of the tape is retained on the vacuum roller. The brake means is preferably automatically released at a predetermined time interval after cutting the tape, and the apparatus preferably further includes a retaining finger which is automatically pivoted toward the vacuum roller so that it engages the adhesive surface of the tape to capture the tape between the retaining finger and the vacuum roller after a cutting operation in order to prevent movement of the tape in a reverse direction.

It has been found that the tape applicator of the apparatus of the instant invention can be effectively utilized for applying an adhesive tape to a wire spool in a high-speed operation, and that as a result the tape applicator can be effectively utilized in a dual reel continuous wire take-up apparatus. Specifically, it has been found that the tape applicator of the instant invention can be effectively utilized for applying tape to the outer layers of wire on the wire spools of a wire take-up apparatus which is capable of operating with wire take-up speeds of 2000 feet per minute, or more.

Accordingly, it is a primary object of the instant invention to provide an apparatus for automatically applying a length of tape to the wire on the outer surface of a wire spool.

Another object of the instant invention is to provide a means for effectively automatically packaging a spool of wire without allowing the free outer end portion of the wire to unravel therefrom.

An even still further object of the instant invention is to provide a high speed tape applicator apparatus which is operative for applying a length of tape to a wire on the outer surface of a wire spool in a continuous wire take-up apparatus.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
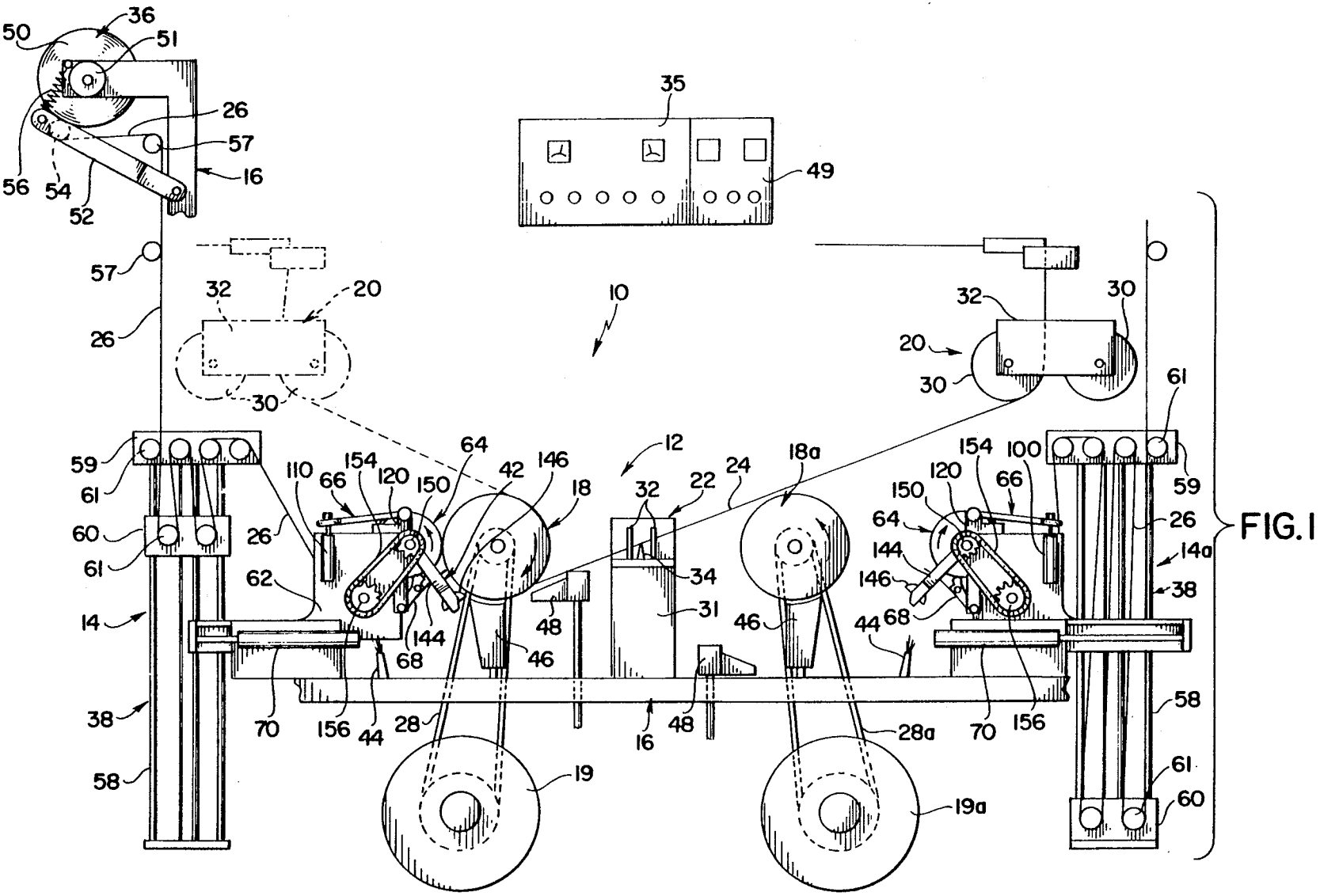
FIG. 1 is a side elevational view of the apparatus of the instant invention.

Referring now to the drawings, the apparatus of the instant invention is illustrated in FIGS. 1 through 9 and generally indicated at 10 in FIG. 1. The apparatus 10 comprises a wire take-up apparatus generally indicated at 12, and a pair of tape applicator assemblies generally indicated at 14, and 14*a*. The wire take-up apparatus 12 is configured as a conventional continuous dual reel take-up apparatus including first and second wire spools 18 and 18*a*, respectively, which are driven by first and second drive motor assemblies 19 and 19*a*, respectively, a wire traverse assembly generally indicated at 20, and a wire knife assembly generally indicated at 22. During operation of the apparatus 10, the wire take-up apparatus 12 is operative for alternatively winding a continuous wire 24 onto the first wire spool 18, or the second wire spool 18*a*, and it is further operative for cutting the wire 24 and feeding it onto the other spool 18 or 18*a* so that the original spool 18 or 18*a* can be changed without interrupting the continuous advancement of the wire 24. The tape applicator assemblies 14 and 14*a* are operative for applying lengths of tape 26 to the wire 24 on the spools 18 and 18*a*, respectively, after they have been filled with wire 24 in order to retain the respective exposed terminal end portions of the wire 24 thereon.

The wire take-up apparatus 12 is of conventional construction, the various components thereof being mounted and/or supported on the frame 16. The wire spools 18 and 18*a* are rotatably mounted so that they are driven by the drive motor assemblies 19 and 19*a*, respectively, and the wire traverse assembly 20 is mounted on the frame 16 above the spools 18 and 18*a* so that it is movable between the two positions thereof illustrated in FIG. 1. The traverse assembly 20 includes a pair of guide rollers 30 which are rotatably mounted on a frame 32 and it is operative for guiding the wire 24 so that it is evenly wound onto the spools 18 and 18*a*. The wire knife assembly 22 includes a support 31, a pair of deflector bars 32, and a knife 34, and it is actuatable for cutting the wire 24 in a conventional manner.

The wire take-up apparatus 12 preferably includes a conventional control assembly 35 which is operative for controlling the operation of the motors 19 and 19*a*, the traverse assembly 20, and the wire knife assembly 22 in a conventional manner. Specifically, the control assembly 35 is preferably operative for determining when a predetermined amount of wire has been wound onto a particular spool 18 or 18*a* and for then repositioning the traverse assembly 20 to the opposite position thereof. The control assembly 35 is preferably further operative for then cutting the wire 24 with the knife assembly 22, and guiding the wire 24 with the knife assembly 22 so that the wire is fed onto the empty spool 18 or 18*a*. More specifically, referring to the operation for the apparatus 12 as illustrated in FIG. 1, while the wire 24 is initially applied to the first wire spool 18, the traverse assembly 20 is normally located in the left-hand position thereof illustrated in phantom in FIG. 1. However, when a predetermined length of the wire 24 has been wound onto the spool 18 the drive motor assembly 19*a* is actuated and the traverse assembly 20 is moved to the right-hand position thereof illustrated in solid lines in FIG. 1. The knife assembly 22 is then operated by the controller 35 for cutting the wire 24 and for guiding the wire 24 so that it is wound onto the second spool 18*a*. At a predetermined relatively short time interval after the wire 24 has been cut, the motor 19 is deactuated so that the first full spool 18 can be removed from the apparatus 12 and replaced with another empty spool.

The tape applicator assemblies 14 and 14*a* are identical with the exception that the applicator assembly 14*a* is a mirror image of the applicator assembly 14. Each of the tape applicator assemblies 14 and 14*a* comprises a tape supply roll assembly generally indicated at 36, an accumulator assembly generally indicated at 38, a vacuum roller assembly generally indicated at 40, a tape knife assembly generally indicated at 42, an air jet 44, and a pair of wire tail guides 46 and 48; and a pneumatic controller 49 is provided for controlling both of the tape applicators 14 and 14*a*. During operation of each of the tape applicator assemblies 14 and 14*a*, a length of tape 26 is drawn from the respective tape supply roll assembly 36 thereof and retained in the tape accumulator assembly 38 thereof while the wire 24 is being wound onto the respective spool 18 or 18*a* thereof. Once a predetermined quantity of wire 24 has been wound onto the respective spool 18 or 18*a* thereof, the wire 24 is cut with the wire knife assembly 22, and the vacuum roller assembly 40 thereof is moved into engagement with the wire 24 on the spool 18 or 18*a* to apply a length of the tape 26 to the free end portion of the wire 24 thereon.

Each of the tape supply roll assemblies 36 comprises a supply roll 50 of tape, such as 3M Scotch Brand Pressure Sensitive Film Box Sealing Tape, which preferably has a width of approximately one and one-half inches. Each of the tape supply roll assemblies 36 further comprises a pneumatic brake assembly 51 which is actuatable for retaining the supply roll 50 in a stationary position, and a tension arm 52 having a tension roller 54 mounted thereon which is biased to a position of engagement with the supply roll 50 thereof by means of a spring 56. Each of the tape supply roll assemblies 36 further comprises a plurality of guide rollers 57 which are operative for guiding the tape 26 from the respective tape supply roll 50 thereof to the accumulator assembly 38 thereof.

Each of the accumulator assemblies 38 comprises a track assembly 58, an upper end member 59, and a carriage member 60. Each of the accumulator assemblies 38 further includes a plurality of rollers 61 on the end member 59 thereof and the carriage member 60 thereof. Each of the carriage members 60 is received on the respective track assembly 58 thereof so that it is pneumatically repositionable thereon for movement toward an expanded, or loaded, position and so that it is also movable toward a contracted, or unloaded, position. In this regard, as illustrated in FIG. 1 the accumulator assembly 38 of the tape applicator 14*a* is disposed in the expanded or loaded position thereof, whereas the accumulator assembly 38 of the tape applicator assembly 14 is disposed in the contracted, or unloaded, position. Each of the accumulator assemblies 38 is constructed so that it is normally operative for moving to the expanded position thereof under a pneumatic pressure of approximately 20 psi, and for resisting movement to the contracted position thereof under a pneumatic pressure of approximately 5 psi when a force is applied to the respective tape 26 thereof sufficient to longitudinally pull the latter from the accumulator assembly 38. Each of the accumulator assemblies 38 is operative for rapidly supplying a length of tape 26 to the respective vacuum roller assembly 40 thereof so that the tape 26 can be applied to the outer layers of the wire 24 on the respective wire spool 18 or 18*a* thereof while the latter is rotated at a high rate of rotation. Further, once a length of the tape 26 has been applied to the wire 24 on one of the spools 18 or 18*a*, the respective accumulator assembly 38 thereof is effectively pneumatically movable to the expanded position thereof as a new length of tape 26 is drawn from the supply roll 50. This operation of each of the accumulator assemblies 38 is coordinated with the respective tape supply roller assembly 36 thereof so that the brake assembly 51 of the respective supply roller assembly 36 is normally maintained in a braking position except while the accumulator assembly 38 thereof is being moved to the expanded position thereof.

Each of the vacuum roller assemblies 40 comprises a carriage member or slide 62, a vacuum roller element 64, a brake assembly 66, a retaining finger assembly 68, a pneumatic piston assembly 70, and a roller and guide assembly 72. Each of the carriage members 62 has an elongated slot or track 74 formed therein, and each includes a retaining member (not shown) which is receivable through the respective track 74 thereof for slidably retaining the carriage member 62 thereof on the frame 16. Each of the pneumatic piston assemblies 70 is operative for laterally repositioning the respective carriage member 62 thereof on the frame 16 in order to reposition the respective vacuum roller assembly 40 thereof relative to the respective spool 18 or 18*a* thereof. Each of the vacuum roller elements 64 is rotatably mounted on the carriage member 62 thereof as will hereinafter be more fully set forth, and each of the brake assemblies 66 is operative for applying a braking force to the respective vacuum roller element 64 thereof in order to arrest the rotation thereof, as will also hereinafter be more fully set forth. Each of the retaining finger assemblies 68 is pivotally mounted on the respective carriage member 62 thereof, and each is biased toward the respective roller element 64 thereof so that each retaining finger assembly 68 engages the respective tape 26 thereof to retain the tape 26 thereof in engagement with the respective vacuum roller element 64 thereof and to prevent movement of the tape 26 thereof in a reverse direction. Each of the guide roller assemblies 72 is operative for guiding the respective tape 26 thereof from the respective accumulator assembly 38 thereof to the respective vacuum roller element 64 thereof.

Figure 4:
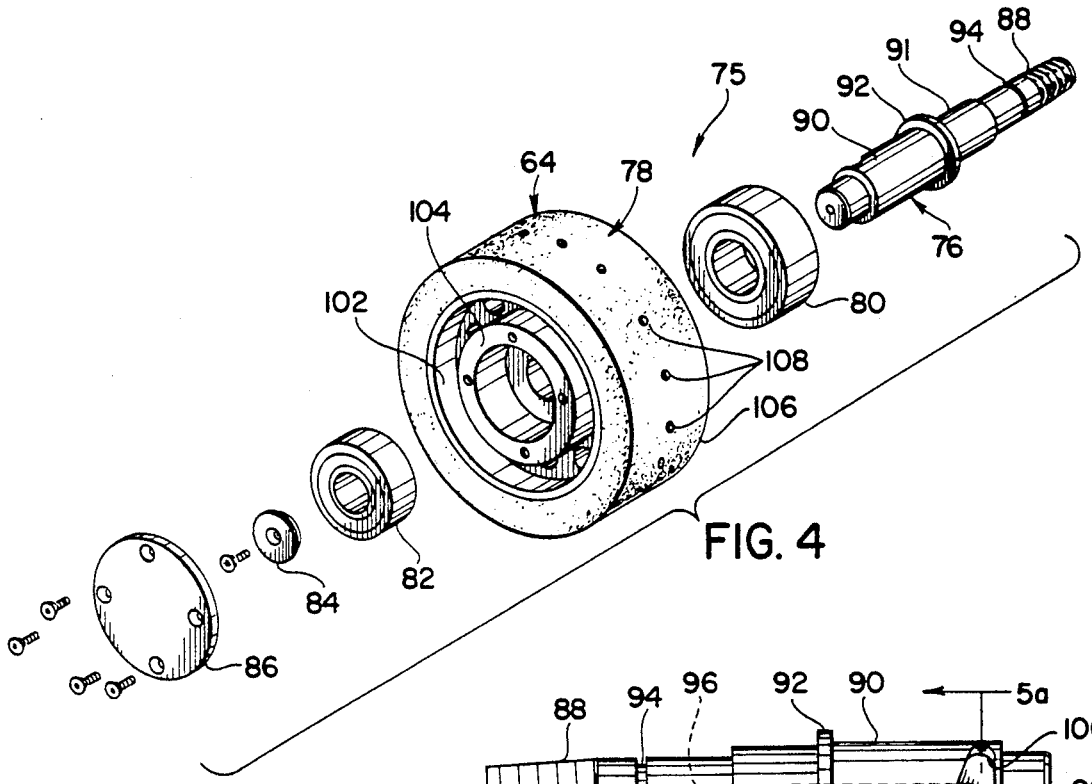
FIG. 4 is an exploded perspective view of the vacuum roller.
Figure 5:
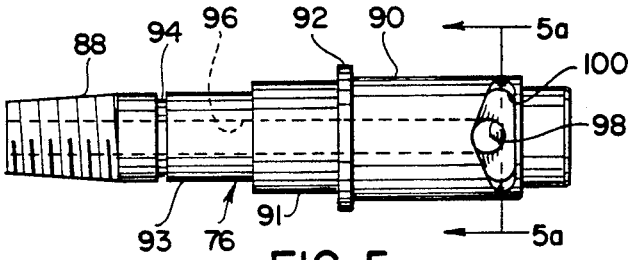
FIG. 5 is a side elevational view of the vacuum roller shaft.
Figure 5A:
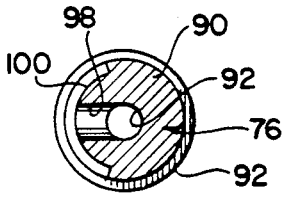
FIG. 5*a* is a sectional view taken along line 5*a*—5*a* in FIG. 5.
Figure 6:
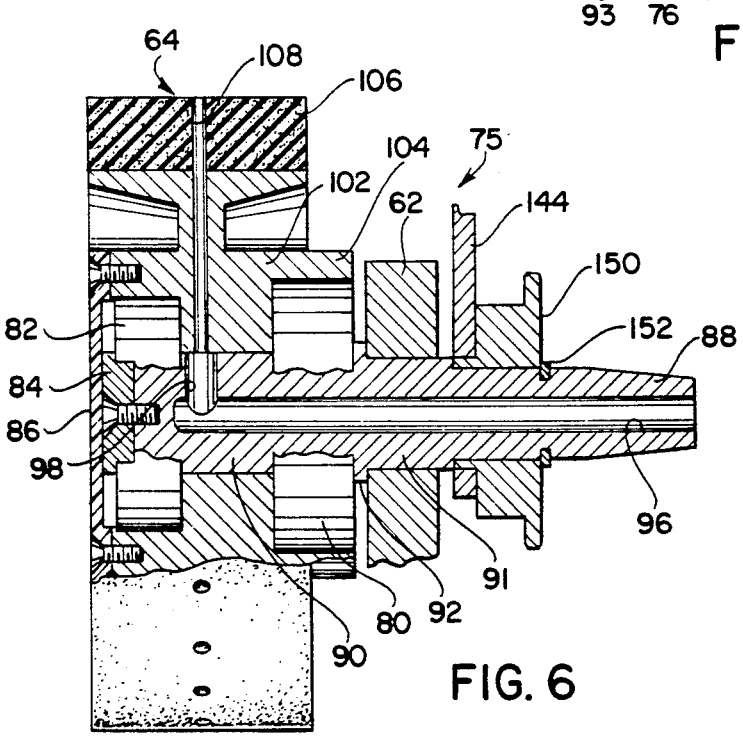
FIG. 6 is a fragmentary sectional view of the vacuum roller.
Figure 7:
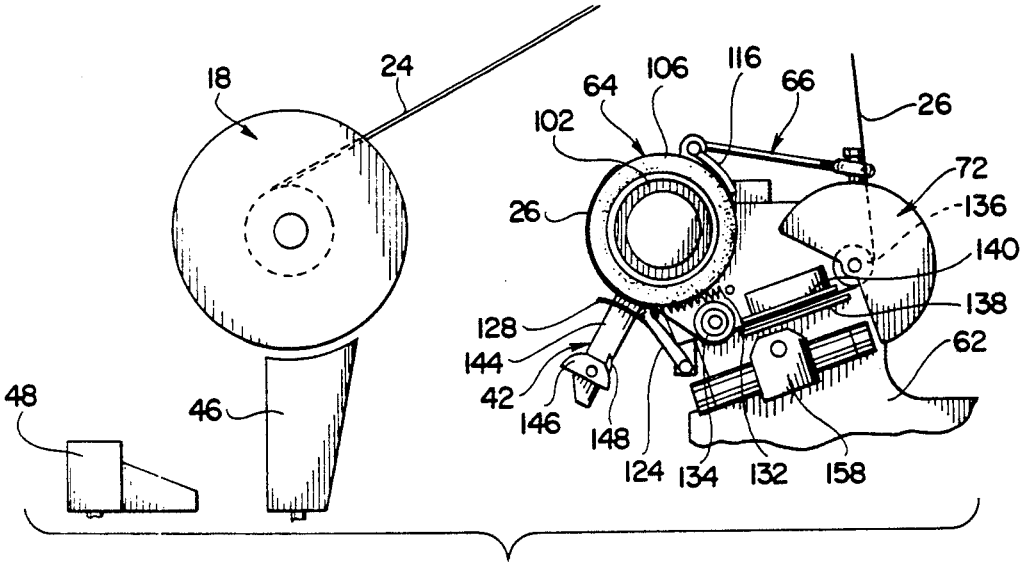
FIGS. 7 through 9 are sequential rear views of the right hand tape applicator illustrated in FIG. 1 as operated for applying a length of tape to a wire spool.

Referring to FIGS. 4 through 6, each of the vacuum roller elements 64 is mounted on the respective carriage member 62 thereof with a shaft and bearing assembly generally indicated at 75 comprising a vacuum shaft generally indicated at 76, a bearing 80, a one-way clutch bearing 82, a retainer piece 84, and an end cap 86. Each of the shafts 76 includes a tapered threaded end portion 88 which is connected to a vacuum source by means of a vacuum fitting 89, an enlarged section 90, a slightly reduced intermediate section 91, a flange 92 between the enlarged section 90 and the intermediate section 91, a further reduced end section 93 and a retaining ring groove 94. An axial bore 96 extends axially inwardly into each of the shafts 76 from the threaded end portion 88 thereof to a point which is closely spaced inwardly from the opposite end of the shaft 76, and a bore 98 extends outwardly from the axial bore 96 to an open channel 100 which extends over an arc of approximately 120° on the surface of the enlarged section 90 thereof. Each of the vacuum roller elements 64 includes a wheel portion 102 which is preferably made from a relatively light weight metal, such as aluminum, and includes a hub section 104. Each of the vacuum roller elements 64 further includes an outer layer 106 which is preferably made from a resilient elastomeric material in a thickness of at least approximately ½ inch. A plurality of bores 108 having diameters of approximately 1/16th inch extend outwardly from the inner diameter of the hub portion 104 of each of the vacuum roller elements through the wheel portion 102 thereof and the outer layer 106 thereof, the bores 108 preferably being angularly spaced at intervals of approximately 20° in the vacuum roller elements 64. Each of the vacuum roller elements 64 is adapted to be rotatably mounted on the enlarged portion 90 of the respective shaft 76 thereof with the respective bearing 80 and clutch bearing 82 thereof received on the enlarged portion 90 so that a portion of the bores 108 in the vacuum roller element 64 communicate with the channel 100 in the shaft 76 thereof. Accordingly, at any given time a portion of the bores 108 extending over an arc of approximately 120° are aligned with the respective channel 100 thereof to apply vacuum to a vacuum segment of the outer surface of the respective vacuum roller element 64 thereof extending over an arc of approximately 120°. Each of the vacuum shafts 76 is non-rotatably mounted on the respective carriage 62 thereof so that the vacuum segment on the outer surface of the vacuum roller element 64 thereof extends upwardly from the lower side of the vacuum roller element 64 to a point which faces the adjacent spool 18 or 18*a*. Each of the bearings 80 is assembled in the hub section 104 of the vacuum roller element 64 thereof for rotatably mounting the latter on the shaft 76, and each of the one-way clutch bearings 82 is received on the shaft 76 thereof and assembled in the hub section 104 thereof so that the clutch bearing 82 thereof is operative for preventing rotation of the respective vacuum roller element 64 thereof in a reverse direction. Each of the retaining elements 84 is received on the terminal end of the respective shaft 76 thereof for retaining the respective clutch 82, vacuum roller 64 and bearing 80 thereon. Further, each of the end caps 86 is assembled on the respective hub section 104 thereof for enclosing the clutch 82 and the retaining element 84 thereof, and for further retaining the respective clutch 82, vacuum roller element 64, and bearing 80 thereof on the shaft 76 thereof in a manner which seals the vacuum at the end of the hub section 104. Each of the shafts 76 is received in a bore (not shown) in the carriage member 62 thereof, and a set screw (not shown) is provided for non-rotatably retaining each of the shafts 76 in assembled relation with the respective carriage member 62 thereof.

Figure 2:
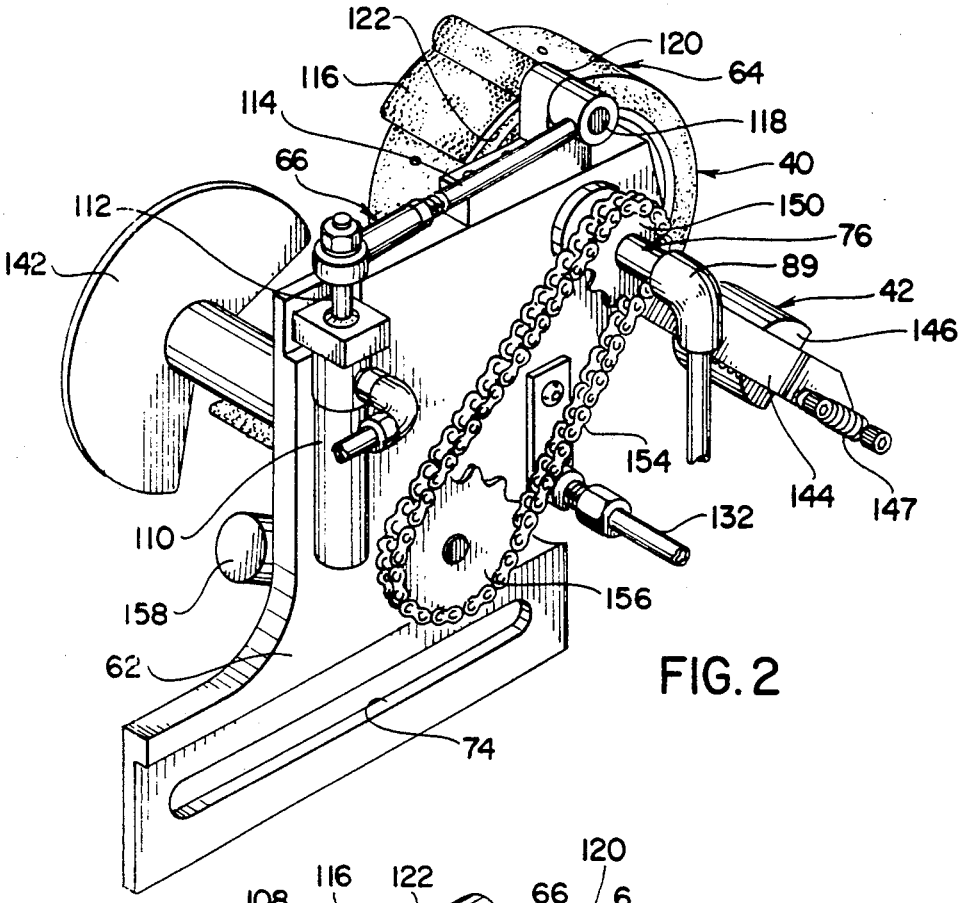
FIG. 2 is a front perspective view of the main components of the tape applicator thereof.
Figure 3:
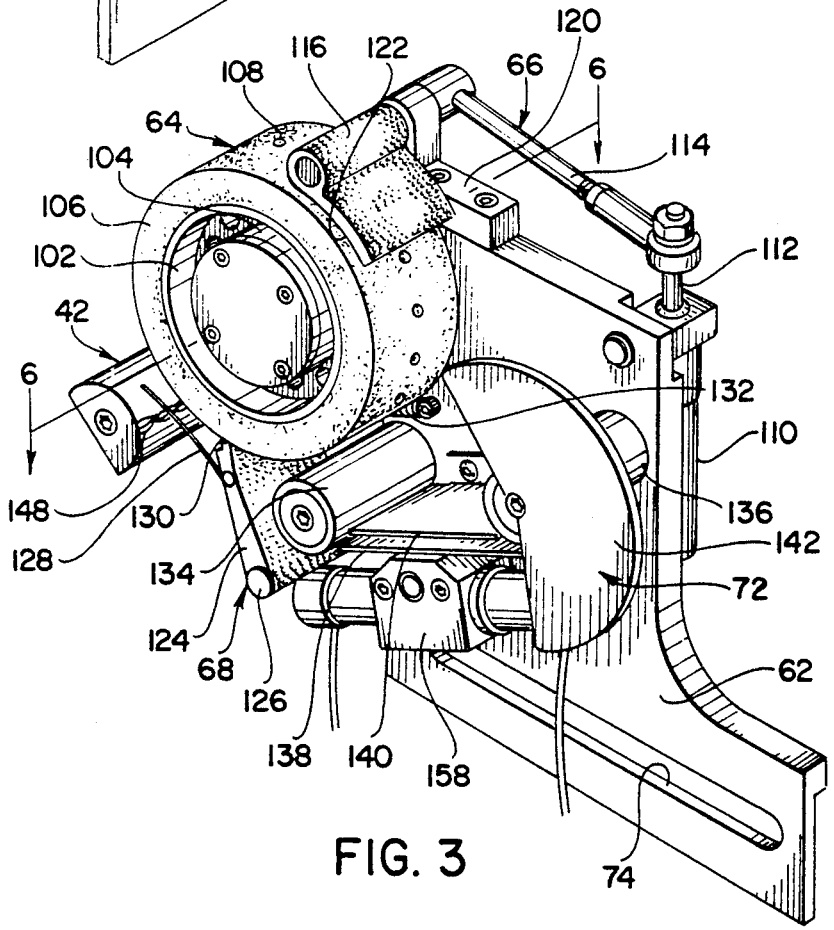
FIG. 3 is a rear perspective view of the main components of the tape applicator.

One of the brake assemblies 66 is illustrated in FIGS. 2 and 3 and it includes a pneumatic piston assembly 110 having a piston rod 112, a connecting rod 114, and a brake element 116. Each of the pneumatic piston assemblies 110 is mounted on the carriage 62 thereof and each is operative for vertically repositioning the respective piston rod 112 thereof. Each of the brake elements 116 includes a mounting shaft 118 and each is pivotally mounted on the carriage 62 thereof with a pivot block 120, so that the shaft 118 thereof extends through the pivot block 120 thereof to the connecting rod 114 thereof. Accordingly, by vertically repositioning one of the piston rods 112, the pivot shaft 118 thereof is rotated in the pivot block 120 thereof to pivot the brake element 116 thereof. Each of the brake elements 116 is formed as an arcuate paddle-like braking element and each has an arcuate inner surface 122 which substantially conforms to the outer configuration of the outer layer 106 of the respective vacuum roller element 64 thereof. Accordingly, by actuating one of the pneumatic piston assemblies 110 to pivot the pivot shaft 118 thereof, the inner surface 122 of the brake element 116 thereof can be moved from a position of spaced disengagement from the outer surface of the adjacent vacuum roller element 64, to a position of pressurized braking engagement therewith. Each of the brake elements 116 preferably further includes a relatively stiff brush-like fabric, such as a velcro (Velcro U.S.A. TM), hook-type fabric on the outwardly facing surface thereof to prevent the tape 26 from adhering thereto in the event that the adhesive surface of the tape 26 inadvertently contacts the brake element 116.

Each of the retaining finger assemblies 68 comprises a retaining finger element 124 which is preferably made from fiber-reinforced plastic, a pivot shaft 126, and a pair of retaining wires 128. Each of the retaining finger elements 124 preferably has a brush-like stiff pile fabric, such as Velcro (Velcro U.S.A. TM) on the surface thereof which faces generally angularly upwardly toward the respective vacuum roller element 64 thereof to prevent the tape 26 from adhering thereto. Further, each of the retaining finger elements 124 includes a terminal end 130 and each is rotatably mounted on the pivot shaft 126 thereof. Each of the shafts 126 is non-rotatably mounted on the carriage 62 thereof for pivotally mounting the retaining finger element 124 thereof and each of the retaining finger elements 124 is biased toward a position wherein the terminal end 130 thereof urges the adjacent tape 26 against the outer surface of the vacuum roller element 64 thereof with a spring 132. Further, the retaining fingers 124 are angularly oriented relative to the respective vacuum roller elements 64 thereof so that they function as cam cleats for preventing movement of the tapes 26 in reverse directions back toward the respective accumulators 38 thereof as the respective accumulators 38 thereof are moved to expanded positions after the respective tapes 26 thereof have been cut.

Each of the shafts 126 preferably also has a tubular passage therethrough, and each of the retaining finger elements 124 preferably has a plurality of tubular bores therein which communicate with the passage in the shaft 126 thereof and open outwardly through the respective terminal end 130 thereof. Each of the shafts 126 is connected to an air supply tube 132 for supplying air thereto so that the air passes outwardly through the bores at the terminal end 130 of the retaining finger element 124 thereof. The air which normally flows outwardly from the terminal end 130 of each of the retaining finger elements 124 operates to further urge the tape 26 thereof toward the vacuum roller element 64 thereof just after the tape has been cut. A plurality of the retaining wires 128 extends outwardly from each of the retaining finger elements 124 to prevent the respective tape 26 thereof from falling away from the vacuum roller element 64 thereof immediately after the tape 26 has been cut.

Each of the roller and guide assemblies 72 includes a pair of rollers 134 and 136, a pair of lower and upper guide plates 138 and 140 respectively, and a retaining plate 142. The rollers 134 and 136 preferably comprise freely rotatable rollers which include non-stick outer surface layers made from a suitable non-stick material such as Teflon (Dupont TM). The guide plates 138 and 140 are positioned in closely spaced substantially parallel relation so that they are operative for guiding the tapes 26 between the respective guide rollers 134 and 136 thereof, and each of the lower guide plates 138 preferably has a brush-like stiff pile fabric thereon, such as a velcro (Velcro U.S.A. TM) hook-type fabric, in order to prevent the adhesive surface of the tape 26 from adhering thereto. The retaining plates 142 are provided on the respective rollers 136 thereof in order to properly align the respective tapes 26 therewith before the tapes 26 are passed between the respective guide plates 138 and 140 thereof.

One of the knife assemblies 42 is illustrated in FIGS. 2 and 3. As will be seen, each of the knife assemblies 42 includes a knife arm 144 which is pivotally mounted on the shaft 76 thereof, a pivot head 146, a return spring 147 and a plurality of knife blade elements 148 on the respective pivot head 146 thereof adjacent the outer terminal end thereof. Each of the pivot heads 146 is preferably made from a non-stick material, such as Teflon (Dupont TM), and each has an arcuate surface thereon which is engageable with the adhesive surface of the tape 26 for pivoting the respective pivot head 146 thereof to a position wherein the knife elements 148 thereon engage the tape 26 thereof, as will hereinafter be more fully set forth. Each of the pivot heads 146 is biased toward the position illustrated in FIGS. 7 and 8 with the respective return spring 147 thereof. Each of the knife assemblies 42 preferably includes at least six knife elements 148 which are positioned in a line extending across the arcuate surface of the respective pivot head 146 thereof. The knife elements 148 preferably have points which are formed in triangular pyramid-like configurations to provide relatively sharp points at the terminal ends thereof which are capable of readily penetrating the respective tape 26 thereof. Each of the knife assemblies 42 further includes a sprocket 150 which is rotatably received on the shaft 76 thereof so that it abuts the shoulder formed by the end of the intermediate section 91 thereof. Each of the sprockets 150 is attached to the pivot arm 144 thereof for pivoting the latter, and a retaining ring 152 is received in the retaining groove 94 on the respective shaft 76 thereof for retaining the respective sprocket 150 thereon. Further included in each of the knife assemblies 42 is a drive chain 154 which extends from the sprocket 150 thereof to a second sprocket 156 thereof. Each of the second sprockets 156 is rotatably mounted on the carriage 62 thereof, and a pneumatic rotary drive 158 is provided on the opposite side of the carriage 62 thereof from the respective sprocket 156 thereof, for selectively rotating the latter in clockwise and counterclockwise directions. Accordingly, by actuating the pneumatic rotary drive 158 of one of the knife assemblies 42 the sprocket 156 thereof is rotated to rotate the sprocket 150 thereof and pivot the knife arm 144 thereof.

Figure 8:
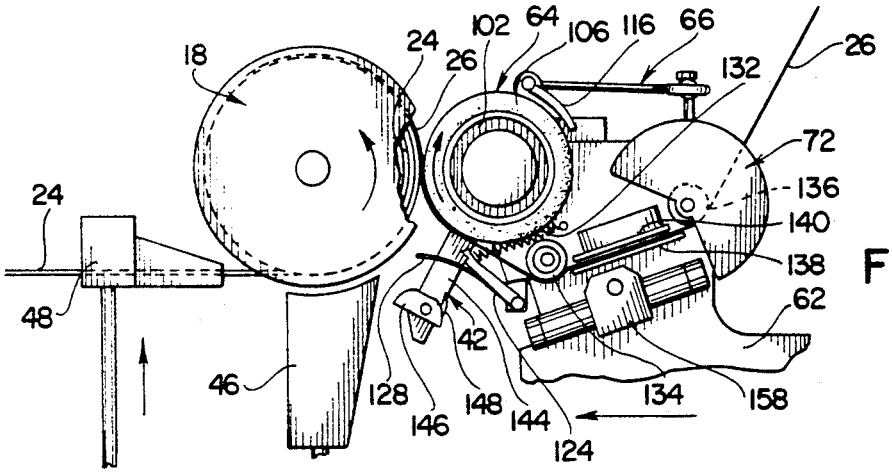
Figure 9:
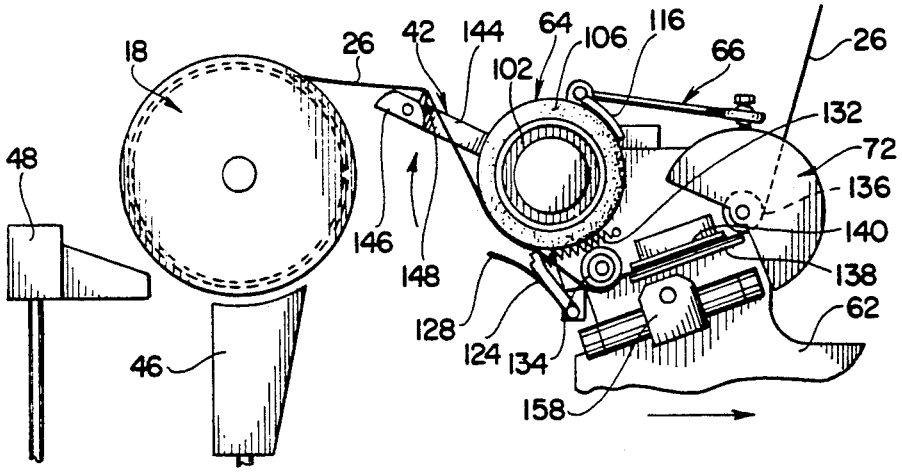

The operation of one of the knife assemblies 42 is illustrated most clearly in FIGS. 8 and 9. As will be seen, during normal operation, and even during the initial stages of applying a section of the tape 26 to the wire 24 on one of the spools 18 or 18*a*, the respective knife arm 144 thereof is maintained in a generally downwardly extending position wherein the pivot head 146 thereof and the knife elements 148 thereof are in spaced relation to the adjacent tape 26. However, once a quantity of tape 26 has been applied to the wire 24 on one of the spools 18 or 18*a*, the respective carriage 62 thereof is moved back away from the spool 18 or 18*a*, and the respective knife arm 144 thereof is immediately pivoted upwardly by the rotary drive 158 thereof to a position wherein the arcuate surface of the respective pivot head 146 contacts the adhesive surface of the adjacent tape 26. This causes the former to be rapidly pivoted so that the knife elements 148 thereon contact the adhesive surface of the adjacent tape 26. As a result, the knife elements 148 sever the portion of the tape 26 which has been applied to the wire 24 on the spool 18 or 18*a* from the remaining portion of the tape 26 on the adjacent vacuum roller 64. After the tape 26 has been cut in this manner the knife arm 144 thereof is returned to its normal downwardly extending position by the rotary drive 158 thereof, and the respective pivot head 146 is returned to its original position by the return spring 147 thereof.

Each of the air jets 44 is mounted on the frame 16 and connected to a source of pressurized air. Each of the air jets 44 is positioned and directed so as to provide an air stream which urges the free end portion of the adjacent tape 26 upwardly after the latter has been cut with the respective knife assembly 42 thereof so that the free end portion of the tape 26 is moved upwardly toward the outer surface of the respective vacuum roller element 64 thereof.

The wire tail guides 46 and 48 are operative for guiding the wire 26 as it is wound onto the spools 18 and 18*a*. Each of the wire tail guides 46 is mounted in a stationary position beneath the respective wire spool 18 or 18*a* thereof and each is constructed and positioned for guiding the tail of the cut wire 24 onto the respective adjacent wire spool 18 or 18*a* thereof so that it is aligned with the respective adjacent vacuum roller 64 thereof. Each of the wire tail guides 48 is mounted on the frame 16 between the respective wire tail guide 46 thereof and the wire knife assembly 22. Further, each of the wire tail guides 48 is adapted so that it is pneumatically vertically repositionable between the raised or operative position of the wire tail guide 48 of the applicator 14 illustrated in the left hand portion of FIG. 1 and the lowered or inoperative position of the wire tail guide 48 of the applicator 14*a* illustrated in the right hand portion of FIG. 1. Each of the wire tail guides 48 is pneumatically moved to the operative position just before the wire 24 is cut with the wire knife assembly 22 so that the wire tail guide 48 guides the wire 24 onto the respective spool 18 or 18*a* thereof during a wire cutting operation. Further, each of the wire tail guides 48 is operative for guiding the free end portion of the wire 24 onto the respective spool 18 or 18*a* thereof immediately following a wire cutting operation.

The controller 49 comprises a conventional pneumatic controller, and as herein embodied the controller 49 is adapted for performing a dual function of controlling both the applicator 14 and the applicator 14*a*. It will be understood, however, that other embodiments which include separate controllers for the applicators 14 and 14*a* and other embodiments wherein the controller 49 is formed as part of the controller 35 are contemplated. In any event, the controller 49 as herein embodied comprises a conventional controller which is programmable by conventional programming techniques for controlling the operation of the tape applicators 14 and 14*a* as herein described.

Referring again to FIG. 1, during operation of the apparatus 10 for applying the wire 24 to the spool 18, the drive motor assembly 19 is operated to rotate the spool 18, while the traverse assembly 20 is located in a position above the tape applicator assembly 14. The traverse assembly 20 is controlled by the controller 35 for evenly applying the wire 24 to the spool 18 by traversing back and forth relative to the circumferential surface defined by the wire 24 on the spool 18. Once a predetermined quantity of the wire 24 has been wound onto the spool 18, the traverse assembly 20 is automatically moved to a position above the applicator assembly 14*a* so that the wire 24 passes in front of the wire knife assembly 22 and the drive motor assembly 19*a* is actuated. The wire guide 48 is then moved upwardly in front of the spool 18 when the wire 24 is at a location on the surface of the spool 18 which is aligned with the vacuum roller 64 so that the wire guide 48 maintains the wire 24 in aligned relation with the adjacent vacuum roller 64. The wire knife assembly 22 is then operated for cutting the wire 24 so that the wire 24 is simultaneously fed onto the spool 18*a* and at approximately the same time the controller 49 operates to control the operation of the applicator 14 by actuating piston assembly 70 for moving the carriage 62 inwardly so that the tape 26 on the vacuum roller 64 engages the wire 24 on the spool 18. Further, when the piston assembly 70 is actuated for moving the carriage 62 inwardly, the pneumatic pressure to the accumulator assembly 38 is reduced by the controller 49 to enable the tape to be drawn at reduced tension from the accumulator assembly 38 as it is applied to the wire 24 on the spool 18. As soon as the tape on the vacuum roller 64 contacts the wire on the spool 18, the carriage 62 is immediately retracted by the piston assembly 70, and the controller 49 operates to apply braking pressure to the vacuum roller 64 with the brake assembly 66 to arrest further rotation of the vacuum roller 64. Further, the controller 49 operates to pivot the knife arm 144 upwardly with the rotary drive 158 so that the arcuate surface of the pivot member 146 contacts the adhesive surface of the tape 26 in the area where the tape 26 extends between the vacuum roller 64 and the spool 18. As the pivot member 42 contacts the tape 26 it is pivoted upwardly by the tape so that the knife elements 148 penetrate the tape 26 to cut the latter between the vacuum roller 64 and the spool 18. As a result, a length of tape 26 is applied to the free end portion of the wire 24 on the spool 18 as the spool 18 is rotated to retain the free end portion of the wire 24 thereon against unwinding. Once the tape 26 has been cut in this manner the remaining end portion of the tape is retained by the wires 128, and then moved upwardly by the air from the air jet 44 and the air passing outwardly from the apertures at the end of the retaining finger 124. Once the remaining end portion of the tape 26 is brought into contact with the vacuum roller 64, the vacuum which is constantly applied to the vacuum roller 64 through the apertures 108 operates to maintain the tape 26 in engagement with the vacuum roller 64. At this point the controller 49 operates to release the brake assembly 66 so that braking pressure is no longer applied to the vacuum roller element 64. Further, the retaining finger 124 which is resiliently biased toward the vacuum roller 64 operates to prevent the tape 26 from traveling in a reverse direction back toward the accumulator 38. Once the tape 26 has been cut in this manner the controller 49 operates the rotary drive 158 to return the knife arm 144 to the downwardly extending position illustrated in FIGS. 1, 2, 7, and 8, and the return spring 147 returns the pivot member 146 to the normal position thereof illustrated in FIGS. 1, 2, 7, and 8. Once the carriage 62 has been returned to its initial position, the brake 51 on the tape roll 50 is released by the controller 49 and the pneumatic pressure to the accumulator assembly 38 is increased by the controller 49 so that the accumulator assembly 38 is moved to the original loaded, or extended, position thereof wherein a predetermined length of tape 26 is contained thereon. Once the accumulator assembly 38 has been filled with tape the brake 51 is reapplied to the tape supply roll 50 by the controller 49, and the motor drive assembly 19 is deactuated by the controller 35 so that the spool 18 can be removed from the apparatus 10 and replaced with an empty spool. Thereafter, when a predetermined length of wire 24 has been applied to the spool 18*a*, a similar operation is carried out wherein the wire 24 is again cut and a section of tape 26 is applied to the wire 24 on the spool 18*a* with the tape applicator 14*a*.

It is seen therefore that the instant invention provides an effective wire take-up apparatus. The apparatus 10 includes the tape applicators 14 and 14*a* which are operative for applying the tapes 26 to the respective spools 18 and 18*a* thereof so that the wire 24 on the spools 18 and 18*a* does not become unwound, and so that the spools 18 and 18*a* can be loaded and unloaded in an automated operation. Accordingly, the apparatus 10 is operative for applying wire to spools at substantially increased rates of speed, and it can be utilized in a totally automated operation wherein spools 18 and 18*a* of wire 24 are filled and removed from the apparatus 10 at a high rate of speed. Hence, it is seen that the instant invention represents a significant advancement in the art relating to wire take-up apparatus which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a wire take-up apparatus for winding a predetermined quantity of a continuous wire onto a rotating spool and for automatically cutting said wire when said predetermined quantity of wire has been wound onto said spool, said wire having a thickness, said spool having a width which is substantially greater than the thickness of said wire, the wire on said spool after automatically cutting said wire having an outer wire circumferential surface and terminating in an exposed wire terminal end portion, the improvement comprising tape means for automatically applying a length of adhesive tape to said wire terminal end portion in order to retain said wire terminal end portion on said outer wire circumferential surface, said tape means including means for guiding said wire toward a predetermined location in the width of said spool on said outer wire circumferential surface before said length of tape is applied to said wire terminal end portion.

2. In the wire take-up apparatus of claim 1, said adhesive tape having a opposite adhesive and non-adhesive surfaces, said tape means comprising a rotatable vacuum roller including an outer vacuum roller circumferential surface having at least one vacuum aperture therein, vacuum means for applying a vacuum to a portion of said outer vacuum roller circumferential surface through said vacuum aperture, means for supplying said length of adhesive tape to said outer vacuum roller circumferential surface so that the non-adhesive surface of said adhesive tape faces the outer vacuum roller circumferential surface said vacuum means releasably retaining a portion of said length of adhesive tape on said outer vacuum roller circumferential surface, and means for moving said vacuum roller with a portion of said length of adhesive tape thereon into engagement with said outer wire circumferential surface so that the adhesive surface of said length of adhesive tape contacts said outer wire circumferential surface for thereby adhesively applying said length of tape to said outer wire circumferential surface as said spool is rotated.

3. In the wire take-up apparatus of claim 2, said vacuum roller including a resiliently compressible circumferential layer defining said outer vacuum roller circumferential surface.

4. In the wire take-up apparatus of claim 2, said means for supplying said length of tape to said outer vacuum roller circumferential surface comprising a tape supply roll, and tape accumulator means between said tape supply roll and said vacuum roller for releasably accumulating a portion of said length of tape between said tape supply roll and said vacuum roller, said accumulator means being operative for releasing said portion of said length of tape between said tape supply roll and said vacuum roller upon contact of said length of tape with said outer wire circumferential surface.

5. In the wire take-up apparatus of claim 4, said means for supplying said length of tape to said vacuum roller circumferential surface further comprising means for cutting said tape when said length of tape has been applied to said outer wire circumferential surface.

6. In the wire take-up apparatus of claim 2, said means for moving said vacuum roller with said portion of said length of tape thereon immediately retracting said vacuum roller to a position of spaced disengagement from said outer wire circumferential surface upon contact between the adhesive surface of said length of tape and said outer wire circumferential surface.

7. In the wire take-up apparatus of claim 5, said means for moving said vacuum roller with said portion of said length of tape thereon immediately retracting said vacuum roller to a position of spaced disengagement from said outer wire circumferential surface upon contact between the adhesive side of said length of tape and said outer wire circumferential surface, said means for cutting said tape including a pivot arm having a free terminal end, knife means on said pivot arm adjacent the free terminal end thereof, and means for pivoting said pivot arm about a pivot arm axis so that said knife means is moved into a position of engagement with said tape.

8. In the wire take-up apparatus of claim 7, said knife means including a pivot head pivotally mounted on said pivot arm adjacent the free terminal end thereof and knife blade means on said pivot head, said pivot head contacting the adhesive surface of said tape to cause said pivot head to pivot to a position wherein said knife blade means contacts said tape when said pivot arm is pivoted to move said knife blade means into contact with said tape.

9. In the wire take-up apparatus of claim 8, said pivot head pivoting about an axis which is substantially parallel to the pivot axis of said pivot arm.

10. In the wire take-up apparatus of claim 7, said vacuum roller having a rotational axis, said pivot arm pivoting about the axis of said pivot arm.

11. The wire take-up apparatus of claim 5, further comprising brake means for braking the rotation of said vacuum roller for a predetermined time interval after cutting said tape.

12. In the wire take-up apparatus of claim 5, said means for supplying said length of tape including a remaining portion of tape connected to said length of tape, said apparatus further comprising air jet means for urging said remaining portion of tape toward said vacuum roller after cutting said tape.

13. In the wire take-up apparatus of claim 11, said brake means releasing said vacuum roller to permit free rotation thereof at a predetermined time interval after cutting said tape.

14. In the wire take-up apparatus of claim 2, said vacuum roller having plurality of said vacuum apertures therein at spaced locations in an area extending over between approximately one fourth and one half of the outer circumferential surface thereof.

15. In the apparatus of claim 5, said means for supplying said length of tape including a remaining portion of tape connected to said length of tape, said apparatus further comprising a pivotally mounted retaining finger biased toward a position of engagement with the adhesive surface of said remaining portion of tape to maintain said remaining portion of tape in contact with said vacuum roller and to thereby prevent movement of said remaining portion of tape in a reverse direction back toward said tape supply roll.

16. In the wire take-up apparatus of claim 1, said means for automatically applying a length of adhesive tape to said wire terminal end portion including a knife element for cutting said adhesive tape, said knife element having a cutting tip portion of triangular pyramid-like configuration.

17. In a wire take-up apparatus for winding a predetermined quantity of a continuous wire onto a rotating spool and for automatically cutting said wire when said predetermined quantity of wire has been wound onto said spool, the wire on said spool after automatically cutting said wire having an outer wire circumferential surface and terminating in an exposed wire terminal end portion, the improvement comprising tape means for automatically applying a length of adhesive tape to said wire terminal end portion in order to retain said wire terminal end portion on said outer wire circumferential surface, said adhesive tape having opposite adhesive and non-adhesive surfaces, said tape means comprising a rotatable vacuum roller including an outer vacuum roller circumferential surface having at least one vacuum aperture therein, vacuum means for applying a vacuum to a portion of said outer vacuum roller circumferential surface through said vacuum aperture, means for supplying said length of adhesive tape to said outer vacuum roller circumferential surface so that the non-adhesive surface of said adhesive tape faces the outer vacuum roller circumferential surface, said means for supplying said length of tape to said outer vacuum roller circumferential surface comprising a tape supply roll, and tape accumulator means between said tape supply roll and said vacuum roller for releasably accumulating a portion of said length of tape between said tape supply roll and said vacuum roller, said accumulator means being operative for releasing said portion of said length of tape between said tape supply roll and said vacuum roller upon contact of said length of tape with said outer wire circumferential surface, and means for cutting said tape when said length of tape has been applied to said outer wire circumferential surface, said vacuum means releasably retaining a portion of said length of adhesive tape on said outer vacuum roller circumferential surface, and means for moving said vacuum roller with a portion of said length of adhesive tape thereon into engagement with said outer wire circumferential surface so that the adhesive surface of said length of adhesive tape contacts said outer wire circumferential surface for thereby adhesively applying said length of tape to said outer wire circumferential surface as said spool is rotated, said means for moving said vacuum roller with said portion of said length of tape thereon immediately retracting said vacuum roller to a position of spaced disengagement from said outer wire circumferential surface upon contact between the adhesive side of said length of tape and said outer wire circumferential surface, said means for cutting said tape including a pivot arm having a free terminal end, knife means on said pivot arm adjacent the free terminal end thereof, and means for pivoting said pivot arm about a pivot arm axis so that said knife means is moved into a position of engagement with said tape, said knife means including a pivot head pivotally mounted on said pivot arm adjacent the free terminal end thereof and knife blade means on said pivot head, said pivot head contacting the adhesive surface of said tape to cause said pivot head to pivot to a position wherein said knife blade means contacts said tape when said pivot arm is pivoted to move said knife blade means into contact with said tape.

18. In a wire take-up apparatus for winding a predetermined quantity of a continuous wire onto a rotating spool and for automatically cutting said wire when said predetermined quantity of wire has been wound onto said spool, the wire on said spool after automatically cutting said wire having an outer wire circumferential surface and terminating in an exposed wire terminal end portion, the improvement comprising tape means for automatically applying a length of adhesive tape to said wire terminal end portion in order to retain said wire terminal end portion on said outer wire circumferential surface, said adhesive tape having opposite adhesive and non-adhesive surfaces, said tape means comprising a rotatable vacuum roller including an outer vacuum roller circumferential surface having at least one vacuum aperture therein, vacuum means for applying a vacuum to a portion of said outer vacuum roller circumferential surface through said vacuum aperture, means for supplying said length of adhesive tape to said outer vacuum roller circumferential surface so that the non-adhesive surface of said adhesive tape faces the outer vacuum roller circumferential surface said means for supplying said length of tape to said outer vacuum roller circumferential surface comprising a tape supply roll, and tape accumulator means between said tape supply roll and said vacuum roller for releasably accumulating a portion of said length of tape between said tape supply roll and said vacuum roller, said accumulator means being operative for releasing said portion of said length of tape between said tape supply roll and said vacuum roller upon contact of said length of tape with said outer wire circumferential surface, means for cutting said tape when said length of tape has been applied to said outer wire circumferential surface, brake means for braking the rotation of said vacuum roller for a predetermined time interval after cutting said tape, said vacuum means releasably retaining a portion of said length of adhesive tape on said outer vacuum roller circumferential surface, and means for moving said vacuum roller with a portion of said length of adhesive tape thereon into engagement with said outer wire circumferential surface so that the adhesive surface of said length of adhesive tape contacts said outer wire circumferential surface for thereby adhesively applying said length of tape to said outer wire circumferential surface as said spool is rotated.

19. In a wire take-up apparatus for winding a predetermined quantity of a continuous wire onto a rotating spool and for automatically cutting said wire when said predetermined quantity of wire has been wound onto said spool, the wire on said spool after automatically cutting said wire having an outer wire circumferential surface and terminating in an exposed wire terminal end portion, the improvement comprising tape means for automatically applying a length of adhesive tape to said wire terminal end portion in order to retain said wire terminal end portion on said outer wire circumferential surface, said adhesive tape having opposite adhesive and non-adhesive surfaces, said tape means comprising a rotatable vacuum roller including an outer vacuum roller circumferential surface having at least one vacuum aperture therein, vacuum means for applying a vacuum to a portion of said outer vacuum roller circumferential surface through said vacuum aperture, means for supplying said length of adhesive tape to said outer vacuum roller circumferential surface so that the non-adhesive surface of said adhesive tape faces the outer vacuum roller circumferential surface, said means for supplying said length of tape to said outer vacuum roller circumferential surface comprising a tape supply roll, and tape accumulator means between said tape supply roll and said vacuum roller for releasably accumulating a portion of said length of tape between said tape supply roll and said vacuum roller, said accumulator means being operative for releasing said portion of said length of tape between said tape supply roll and said vacuum roller upon contact of said length of tape with said outer wire circumferential surface, means for cutting said tape when said length of tape has been applied to said outer wire circumferential surface, said means for supplying said length of tape including a remaining portion of tape connected to said length of tape, said apparatus further comprising air jet means for urging said remaining portion of tape toward said vacuum roller after cutting said tape, said vacuum means releasably retaining a portion of said length of adhesive tape on said outer vacuum roller circumferential surface, and means for moving said vacuum roller with said portion of said length of adhesive tape thereon into engagement with said outer wire circumferential surface so that the adhesive surface of said length of adhesive tape contact said outer wire circumferential surface for thereby adhesively applying said length of tape so aid outer wire circumferential surface as said spool is rotated.

20. In a wire take-up apparatus for winding a predetermined quantity of a continuous wire onto a rotating spool and for automatically cutting said wire when said predetermined quantity of wire has been wound onto said spool, the wire on said spool after automatically cutting said wire having an outer wire circumferential surface and terminating in an exposed wire terminal end portion, the improvement comprising tape means for automatically applying a length of adhesive tape to said wire terminal end portion in order to retain said wire terminal end portion on said outer wire circumferential surface, said adhesive tape having opposite adhesive and non-adhesive surfaces, said tape means comprising a rotatable vacuum roller including an outer vacuum roller circumferential surface having at least one vacuum aperture therein, vacuum means for applying a vacuum to a portion of said outer vacuum roller circumferential surface through said vacuum aperture, means for supplying said length of adhesive tape to said outer vacuum roller circumferential surface so that the non-adhesive surface of said adhesive tape faces the outer vacuum roller circumferential surface, said means for supplying said length of tape including a remaining portion of tape connected to said length of tape, said apparatus further comprising a pivotally mounted retaining finger biased toward a position of engagement with the adhesive surface of said remaining portion of tape to maintain said remaining portion of tape in contact with said vacuum roller and to thereby prevent movement of said remaining portion of tape in a reverse direction back toward said tape supply roll, said means for supplying said length of tape to said outer vacuum roller circumferential surface comprising a tape supply roll, and tape accumulator means between said tape supply roll and said vacuum roller for releasably accumulating a portion of said length of tape between said tape supply roll and said vacuum roller, said accumulator means being operative for releasing said portion of said length of tape between said tape supply roll and said vacuum roller upon contact of said length of tape with said outer wire circumferential surface, means for cutting said tape when said length of tape has been applied to said outer wire circumferential surface, said vacuum means releasably retaining a portion of said length of adhesive tape on said outer vacuum roller circumferential surface, and means for moving said vacuum roller with a portion of said length of adhesive tape thereon into engagement with said outer wire circumferential surface so that the adhesive surface of said length of adhesive tape contacts said outer wire circumferential surface for thereby adhesively applying said length of tape to said outer wire circumferential surface as said spool is rotated.

* * * * *